US005618483A

United States Patent [19]

Weigel et al.

[11] Patent Number: 5,618,483

[45] Date of Patent: Apr. 8, 1997

[54] PROCESS OF MAKING FLEXIBLE CELLULOSE FIBERS

[75] Inventors: Peter Weigel, Kleinmachnow; Albrecht Bauer, Teltow; Konrad Frigge, Potsdam; Jürgen Gensrich; Wolfgang Wagenknecht, both of Teltow, all of Germany

[73] Assignee: Fraunhofer Gesellschaft Petentabteilung, Munich, Germany

[21] Appl. No.: 469,426

[22] Filed: Jun. 6, 1995

[30] Foreign Application Priority Data

Jun. 10, 1994 [DE] Germany ..... 44 20 304.7

[51] Int. Cl.[6] ..... D01D 10/06; D01F 1/10; D01F 2/24

[52] U.S. Cl. ..... 264/187; 264/211; 264/233; 264/234

[58] Field of Search ..... 264/187, 211, 264/233, 234

[56] References Cited

U.S. PATENT DOCUMENTS 3,767,756 10/1973 Blades .
4,142,913 3/1979 McCorsley, III .

FOREIGN PATENT DOCUMENTS 2830685 2/1979 Germany .
142898 7/1980 Germany .
201703 8/1983 Germany .
218121 1/1985 Germany .
229708 11/1985 Germany .
1224362 4/1986 U.S.S.R. .

OTHER PUBLICATIONS

"Spinning of Cellulose from N–Methyl Morpholine N–Oxide in the Presence of Additives", H. Canzy, M. Paillet and R. Hagege, *Polymer* , 31, 400–405 (1990).

*Primary Examiner*—Leo B. Tentoni
*Attorney, Agent, or Firm*—Evenson, McKeown, Edwards & Lenahan, P.L.L.C.

[57] ABSTRACT

This invention relates to flexible cellulose fibers with a reduced modulus and a decreased NMR degree of order, particularly for use in the textile field, which are obtained by pressing out solutions of the cellulose in hydrous NMMNO through spinning nozzles along an air travel into an NMMNO-containing aqueous and/or alcoholic precipitation bath as well as by a conventional rinsing, aftertreatment and drying, with strengths of between 15 and 50 cN/tex, and to a process for their production. According to the invention, these flexible cellulose fibers have an initial modulus of less than 1,500 cN/tex, and the relationship of the heights of the lines at 88 ppm and 85 ppm above the spectrum base line in the highly resolved $^{13}$C-NMR solid-body spectrum is $\leqq 1$. Furthermore, these flexible cellulose fibers are obtained by means of a process in which specified hydrophilic, low-molecular weight, organic additives, which are soluble in the polymer solution and have mainly nitrogen-containing groupings are added in defined amounts to the spinning solution of the cellulose as well as to the precipitation bath.

20 Claims, No Drawings

PROCESS OF MAKING FLEXIBLE CELLULOSE FIBERS

This invention relates to flexible cellulose fibers with a reduced modulus and a decreased NMR degree of order for use in textile fields in which flexible formed bodies, such as textile fibers and filament yarns, hereinafter called "fibers", are produced and required, and which are produced according to the N-methyl morpholine N-oxide (NMMNO) spinning process, which is less harmful to the environment than the viscose method, and to a process for their production.

Because of high investment costs and particularly because of the considerable harmful effect on the environment, there is significant interest in finding alternatives to the viscose method by which the predominant portion of the reclaimed cellulose fibers is currently produced. The most promising methods include the spinning of solutions of the cellulose in amino oxides, preferably in N-methyl morpholine N-oxide (NMMNO), particularly because the cumbersome path via a derivatizing of the cellulose is avoided. It is known that cellulose is soluble in an NMMNO-water system and can be processed by means of spinning into a usually aqueous NMMNO-solution to form textile fibers (U.S. Pat. No. 4,142,914, German Patent No. 2 830 685, and German Patent No. DD 142 898).

A special characteristic of this process is the instability of the solvent which exists under certain conditions at temperatures which are only slightly above the processing temperature of the spinning solutions, which instability may go as far as an uncontrolled chain reaction. It is therefore part of the prior art to add additives to the spinning solution with the object of stabilizing the spinning solution, particularly of preventing or at least limiting the decomposition of the cellulose as well as the decomposition of the NMMNO (German Patent Document DD 201 703, German Patent Document DD 229 708). For this purpose, various authors mention a whole series of substances, such as amines, gallates, ascorbic acid, hydroquinone and urea. Propyl gallate was found to be particularly effective even in the case of low concentrations. The quantities used for the stabilization are in a range of below 1% relative to cellulose.

However, additives, such as polyethylene glycol, are also used for preventing a gluing-together of the yarns during the spinning process (German Patent Document DD 218 121), or are recognized to be useful for increasing the resistance to tearing and the modulus of the yarns (Chanzy, H., et al.: Polymer 31 (1990), 400–405).

High stabilities and moduli are characteristic of the fibers produced according to the NMMNO process compared to the viscose fibers. Thus, the resistances to tearing are generally in an approximate range of from 20 to 50 cN/tex, wherein cN/tex is centi Newton per rex, and the initial moduli are in a range above approximately 1,500 cN/tex. This means that the strengths are advantageously high but often higher than required, and the moduli are clearly too high for an advantageous application in the field of flexible fibers with good textile usage characteristics in which, for example, the normal viscose fibers with an initial modulus of clearly below 1,500 cN/tex are used which have proven themselves for textile use in clothing.

Although the NMMNO process is already used on an industrial scale, the fibers produced thereby still have some additional disadvantages with respect to those which are produced according to the conventional viscose process. Among other characteristics, they exhibit brittleness and the tendency to fibrillate. The achieved values for the ductile yield are also not satisfactory so that Krutschinin, et al.

(Patent Document SU 1 224 362 of the Soviet Union), for eliminating this deficiency, described, instead of the mostly used precipitation bath made of an aqueous NMMNO-solution, a solution of NMMNO in isopropanol or amyl alcohol. It is also a disadvantage that the variation range of the characteristic textile-physical values is low when the production conditions are changed. Furthermore, the fibers have a relatively high degree of order which, in the highly resolved $^{13}$C-NMR solid-body spectrum, can be recognized at C-1, C-4 and, to a limited extent, also at C-6. The relationship of the line heights (distance of the maximum of the respective line from the base line of the spectrum) at C-4 at approximately 88 and 85 ppm—a relatively easily accessible measurement figure—shows, for example, that, in the case of flexible viscose fibers, this relationship has a value $\leqq 1.0$, whereas, in the case of NMMNO-fibers, it is above one, for example, at 1.35.

Chanzy, et al. (see *Polymer* 31 (1990), 400–405) show a possibility for influencing the modulus of the fibers by adding inorganic salts, such as ammonium chloride or calcium chloride, to the NMMNO spinning solution of the cellulose. However, as a result, a clear increase of the strength and of the modulus is achieved. The tendency of the fibers to be brittle and to fibrillate is increased. This results in a splitting of the fibers when stressed by bending and buckling. Although types of fibers, which exhibit the typical behavior of high-strength, high-modulus fibers, are excellently suitable for many technical purposes, particularly in the form of composites in a fixed matrix, they can hardly be used in the textile field.

Despite the large number of already described additives for the addition to cellulose NMMNO spinning solutions, it has so far not been possible to produce flexible cellulose fibers with a clearly reduced modulus and a decreased degree of order.

Thus, there is a continued general interest in providing flexible cellulose fibers with a reduced modulus made of NMMNO solutions and in influencing the spinning process such that also flexible fibers which are provided with a lower modulus and are therefore more suitable for being used in the textile field can be produced with a lower degree of order.

It is an object of the present invention to provide such flexible cellulose fibers which do not have any of the disadvantages of the prior art.

It is therefore an object of the invention to provide flexible cellulose fiber with a reduced modulus and a decreased NMR degree of order according to the NMMNO process which can be used in the textile field.

Furthermore, it is an object of the invention to introduce flexible cellulose fibers with a reduced modulus and a decreased NMR degree of order which exhibit no high brittleness and tendency to fibrillate.

It is also an object of the invention to provide a process for producing the flexible cellulose fibers of the above-mentioned type.

Another process-related object of the invention is to ensure that this process for producing the flexible cellulose fibers of the above-mentioned type requires lower investment costs and is less harmful to the environment than the viscose process.

It is therefore an object of the invention to indicate a solution with respect to how flexible cellulose fibers of the above-mentioned type can be produced by means of the NMMNO process.

It is another object of the invention to ensure that this method which is based on the NMMNO process permits a large latitude with respect to the variation range of the characteristic textile-physical values concerning changes of the production conditions.

The objects with respect to the cellulose fibers are achieved by means of a flexible cellulose fiber with a reduced modulus and a decreased NMR degree of order, particularly for use in the field of textiles, which can be obtained by pressing out solutions of the cellulose in hydrous NMMNO (N-methyl morpholine N-oxide) through spinning nozzles along an air travel into an NMMNO-containing aqueous and/or alcoholic precipitation bath as well as by a conventional rinsing, aftertreatment and drying, with strengths of between 15 and 50 cN/tex. According to the invention, these flexible cellulose fibers which can be produced in this manner are characterized in that they have an initial modulus of less than 1,500 cN/tex and, in the highly resolved $^{13}$C-NMR solid-body spectrum, the relationship of the heights of the lines at 88 ppm and 85 ppm (C-4 range above the spectrum base line amounts to $\leqq 1$.

Surprisingly, it was found that, despite the large number of additives suggested in the prior art, it is possible according to the invention to drastically lower the initial modulus and the NMR degree of order of the cellulose fibers precipitated from cellulose NMMNO water spinning solutions if specified hydrophilous, low-molecular, organic additives, which are soluble in the polymer solution and have mainly nitrogen-containing groupings are added in defined amounts to the spinning solution of the cellulose as well as to the precipitation bath.

In this case, advantageously, amines, amides or other substances containing amino groups, preferably those with oxygen-carrying groups (such as carbonyl groups) should be used as possible additives, in which case those with a carbonyl group adjacent to the nitrogen groupings are advantageous, such as urea, caprolactam, amino propanol and/or amino carboxylic acid. If several additives are used simultaneously, it is possible to charge these as individual constituents or as a mixture.

Whether it is more advantageous to use the additives as individual constituents or as a mixture, is determined by the respective concrete application.

Surprisingly, it was also found that the desired effect is the highest when the additive(s) added to the precipitation bath correspond(s) to the additive(s) contained in the spinning solution. This means that the best results were achieved when the additive or additive mixture dissolved in the precipitation bath next to the NMMNO or the additives dissolved in the precipitation bath are identical to those which exist in the spinning solution.

Advantageously, the concentration of the additives in the spinning solution, relative to the cellulose fraction of the solution, should amount to at least 1% by weight, no more than 200 % by weight, preferably at least 10% by weight, no more than 100% by weight. For example, it is advantageous in this case for the concentration of the additives in the spinning solution, relative to the cellulose fraction of the solution, to amount to at least 4% by weight, no more than 75% by weight, preferably at least 10% by weight, no more than 50% by weight. In contrast, a fraction of the additives of at least 0.1% by weight, and no more than 20% by weight, preferably at least 1% by weight, and no more than 10% by weight, relative to the quantity of the total precipitation bath, are advantageous in the precipitation bath.

Furthermore, it was found that the desired effect will also occur if the water in the precipitation bath is partially or completely, preferably completely, replaced by alcohols, particularly by isopropanol or amyl alcohol, in which case the additives may be contained maximally to their saturation concentration in the precipitation bath.

The fibers, which, therefore in an almost conventional manner, are spun from a nozzle by way of an air travel into the precipitation bath and are aftertreated and dried in the normal manner, have an initial modulus, derived in a known fashion from the force/expansion diagram, of clearly below 1,500 cN/tex, preferably even below 1,200 cN/tex, and/or an NMR degree of order of $\leqq 1$ characterized by the height relationship in the maximum of the lines at 88 ppm and 85 ppm above the base line of the highly resolved $^{13}$C-NMR solid-body spectrum in the C-4 range.

By means of the cellulose fibers of the above-mentioned type according to the invention and the process for their production according to the invention, all disadvantages of the prior art could be eliminated and the respective objects could be achieved.

The invention will be explained in detail by means of the examples and diagrams indicated in the following.

EXAMPLE 1

(Comparative Example according to the Prior Art)

A spinning solution of 9.5% cellulose in NMMNO-monohydrate with 0.1% by weight of propyl gallate relative to cellulose as a stabilizer were spun in a laboratory extruder with a 20-hole nozzle at a temperature of 90° C., in which case a 10% solution of NMMNO in water was used as the spinning bath. The fiber has the following parameters:

| | | |
|---|---|---|
| Titer: | | 4.1 tex |
| Resistance to tearing | dry: | 34.3 cN/tex |
| | wet: | 23.2 cN/tex |
| Elongation at tear | dry: | 5.1% |
| | wet: | 8.1% |
| Initial modulus | dry: | 2,117 cN/tex |
| | wet: | 311 cN/tex |

The relationship of the heights of the NMR-lines at 88 and 85 ppm is 1.35.

EXAMPLE 2

Like Example 1, with an addition of 25% urea, relative to the cellulose fraction, in the spinning solution. The fiber has the following parameters:

| | | |
|---|---|---|
| Titer: | | 4.1 tex |
| Resistance to tearing | dry: | 35.6 cN/tex |
| | wet: | 10.5 cN/tex |
| Elongation at tear | dry: | 10.0% |
| | wet: | 18.1% |
| Initial modulus | dry: | 1,922 cN/tex |
| | wet: | 131 cN/tex |

The relationship of the heights of the NMR-lines at 88 and 85 ppm is 1.0.

EXAMPLE 3

As in Example 2, using a spinning bath consisting of a 6% aqueous urea solution. The fiber has the following parameters:

| | | |
|---|---|---|
| Titer: | | 4.1 tex |
| Resistance to tearing | dry: | 33.1 cN/tex |
| | wet: | 12.2 cN/tex |
| Elongation at tear | dry: | 11.5% |
| | wet: | 17.0% |

-continued

| | | |
|---|---|---|
| Initial modulus | dry: | 1,430 cN/tex |
| | wet: | 120 cN/tex |

The relationship of the heights of the NMR-lines at 88 and 85 ppm is 1.0.

EXAMPLE 4

As in Example 2, using a spinning bath consisting of a 10% aqueous urea solution. The fiber has the following parameters:

| | | |
|---|---|---|
| Titer: | | 4.0 tex |
| Resistance to tearing | dry: | 28.0 cN/tex |
| | wet: | 13.2 cN/tex |
| Elongation at tear | dry: | 13.9% |
| | wet: | 19.9% |
| Initial modulus | dry: | 446 cN/tex |
| | wet: | 126 cN/tex |

The relationship of the heights of the NMR-lines at 88 and 85 ppm is 0.96.

EXAMPLE 5

Like Example 1, with an addition of 15% urea, relative to the cellulose fraction, in the spinning solution and using a precipitation bath (spinning bath) consisting of a 10% urea solution. The fiber has the following parameters:

| | | |
|---|---|---|
| Titer: | | 4.0 tex |
| Resistance to tearing | dry: | 31.0 cN/tex |
| | wet: | 10.9 cN/tex |
| Elongation at tear | dry: | 12.3% |
| | wet: | 18.4% |
| Initial modulus | dry: | 1,255 cN/tex |
| | wet: | 110 cN/tex |

The relationship of the heights of the NMR-lines at 88 and 85 ppm is 0.98.

EXAMPLE 6

Like Example 1, with an addition of 25% caprolactam, relative to the cellulose fraction, in the spinning solution. The fiber has the following parameters:

| | | |
|---|---|---|
| Titer: | | 4.2 tex |
| Resistance to tearing | dry: | 31.7 cN/tex |
| | wet: | 10.2 cN/tex |
| Elongation at tear | dry: | 8.8% |
| | wet: | 16.2% |
| Initial modulus | dry: | 1,059 cN/tex |
| | wet: | 165 cN/tex |

The relationship of the heights of the NMR-lines at 88 and 85 ppm is 0.97.

EXAMPLE 7

Like Example 6 but, in addition, using a spinning bath (precipitation bath) consisting of a 10% aqueous caprolactam solution. The fiber has the following parameters:

| | | |
|---|---|---|
| Titer: | | 3.9 tex |
| Resistance to tearing | dry: | 16.5 cN/tex |
| | wet: | 4.0 cN/tex |

-continued

| | | |
|---|---|---|
| Elongation at tear | dry: | 5.6% |
| | wet: | 27.0% |
| Initial modulus | dry: | 669 cN/tex |
| | wet: | 49 cN/tex |

The relationship of the heights of the NMR-lines at 88 and 85 ppm is 0.95 (see Illustration 2).

EXAMPLE 8

Like Example 1, with an addition of 25% amino caproic acid, relative to the cellulose fraction, in the spinning solution. The fiber has the following parameters:

| | | |
|---|---|---|
| Titer: | | 4.2 tex |
| Resistance to tearing | dry: | 25.4 cN/tex |
| | wet: | 10.1 cN/tex |
| Elongation at tear | dry: | 7.1% |
| | wet: | 11.9% |
| Initial modulus | dry: | 1,580 cN/tex |
| | wet: | 278 cN/tex |

The relationship of the heights of the NMR-lines at 88 and 85 ppm is 0.98.

EXAMPLE 9

Like Example 8 but, in addition, using a spinning bath (precipitation bath) consisting of a 10% aqueous amino caproic acid solution. The fiber has the following parameters:

| | | |
|---|---|---|
| Titer: | | 3.9 tex |
| Resistance to tearing | dry: | 18.3 cN/tex |
| | wet: | 5.7 cN/tex |
| Elongation at tear | dry: | 6.1% |
| | wet: | 23.4% |
| Initial modulus | dry: | 760 cN/tex |
| | wet: | 63 cN/tex |

The relationship of the heights of the NMR-lines at 88 and 85 ppm is 0.96.

EXAMPLE 10

Like Example 1, with an addition of 25% amino propanol, relative to the cellulose fraction, in the spinning solution. The fiber has the following parameters:

| | | |
|---|---|---|
| Titer: | | 4.1 tex |
| Resistance to tearing | dry: | 24.9 cN/tex |
| | wet: | 10.5 cN/tex |
| Elongation at tear | dry: | 8.2% |
| | wet: | 13.4% |
| Initial modulus | dry: | 1,126 cN/tex |
| | wet: | 129 cN/tex |

The relationship of the heights of the NMR-lines at 88 and 85 ppm is 0.99.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A process for producing flexible cellulose fibers with a reduced modulus and a decreased NMR degree of order comprising pressing out a spinning solution comprising cellulose in hydrous NMMNO through a spinning nozzle along an air travel into a precipitation bath comprising NMMNO and water, an alcohol, or both, to thereby form said fibers, washing and drying, wherein at least one hydrophilic, low-molecular weight, organic additive which is soluble in the polymer solution and has mainly nitrogen-containing groupings, is added in a defined amount to the spinning solution of the cellulose and to the precipitation bath.

2. Process according to claim 1, wherein the additive is selected from the group consisting of amines, amides, other substances containing amino groups, and mixtures thereof.

3. Process according to claim 2, wherein the additive contains an oxygen-carrying group.

4. Process according to claim 3, wherein the oxygen-carrying group is a carbonyl group.

5. Process according to claim 3, wherein the oxygen-carrying group is adjacent to the nitrogen grouping.

6. Process according to claim 5, wherein the additive is urea, caprolactam, amino caproic acid, or mixtures thereof.

7. Process according to claim 5, wherein the additive is amino propanol.

8. Process according to claim 1, wherein more than one additive is used as a mixture.

9. Process according to claim 1, wherein more than one additive is used as individual constituents.

10. Process according to claim 1, wherein additive(s) added to the precipitation bath are the same as the additive(s) contained in the spinning solution.

11. Process according to claim 1, wherein the additive is added to the spinning solution, relative to the cellulose fraction of the spinning solution, in an amount of at least 1% by weight and no more than 200% by weight.

12. Process according to claim 11, wherein the additive is added to the spinning solution in an amount of at least 10% by weight and no more than 100% by weight.

13. Process according to claim 1, wherein the additive in the precipitation bath amount to at least 0.1% by weight and no more than 20% by weight.

14. Process according to claim 13, wherein the amount of the additive in the precipitation bath is at least 1% and no more than 10%.

15. Process according to claim 1, wherein the precipitation bath comprises a mixture of water and an alcohol.

16. Process according to claim 1, wherein the precipitation bath comprises an alcohol and is water-free.

17. Process according to claim 15, wherein the alcohol is isopropanol, amyl alcohol, or mixtures thereof.

18. Process according to claim 16, wherein the alcohol is isopropanol, amyl alcohol, or mixtures thereof.

19. Process according to claim 1, wherein the alcohol is a lower alkyl alcohol.

20. Process according to claim 19, wherein the lower alkyl alcohol has 1 to 5 carbon atoms.

* * * * *